United States Patent [19]

Meggs et al.

[11] 4,065,986

[45] Jan. 3, 1978

BEST AVAILABLE COPY

[54] SELF-ADJUSTING WRENCH

[76] Inventors: Daniel H. Meggs, 4313 Vista Largo, Torrance, Calif. 90505; Janos Beny, 202 Calle de Sirenas, Redondo Beach, Calif. 90277

[21] Appl. No.: 668,472

[22] Filed: Mar. 19, 1976

[51] Int. Cl.[2] ..... B25B 13/18

[52] U.S. Cl. ..... 81/128

[58] Field of Search ..... 81/128

[56] References Cited

U.S. PATENT DOCUMENTS

| | | | |
|---|---|---|---|
| 183,266 | 10/1876 | Jordan | 81/128 |
| 1,242,097 | 10/1917 | Anderson | 81/128 |
| 1,561,812 | 11/1925 | White | 81/128 |
| 3,195,381 | 7/1965 | Meggs, Jr. | 81/128 |

*Primary Examiner*—James L. Jones, Jr.

*Assistant Examiner*—James G. Smith

*Attorney, Agent, or Firm*—Herzig & Walsh

[57] ABSTRACT

A body is provided forming a handle. A pair of complementary jaw members fit within the body and move longitudinally therein. The jaw members are configurated at their outer ends so as to be complementary and together to form a nut engaging configuration. Cam surfaces are provided on the insides of the body in a position to engage surfaces of the jaw members for camming them toward each other when a nut is engaged by the jaw members and a force is applied in a direction toward the nut. The jaw members move inwardly with respect to the body and are cammed towards each other to tightly engage and hold the nut. Preferably, the jaw members are pivoted together within the body and a spring is provided to normally urged them outwardly.

7 Claims, 3 Drawing Figures

SELF-ADJUSTING WRENCH

BACKGROUND OF THE INVENTION

1. Field of the Invention

The field of the invention is that of wrenches, and more particularly, a type of wrench having automatic adjustability.

2. Description of the Prior Art

The invention described herein is an improvement upon the inventor's prior U.S. Pat. No. 3,195,381 granted July 20, 1965. This patent shows an automatic self-adjusting wrench having a body and a pair of jaw members which move longitudinally within the body. The assembly of this wrench includes an actuator member that has attachment to the jaws. The actuator member engages the nut to which the wrench is being applied, and when the force is applied, the actuator member actuates or moves the jaw members into engagement with the nut. The jaw members are in crossed overlapping relationship and the body is internally configurated to receive the jaw members and a compression spring which acts on the actuator member. The wrench of the patent is satisfactory and operative, but it leaves room for improvement by way of simplification of the structure and reduction in the number of parts. The herein invention provides improvements of this nature as specifically identified hereinafter.

SUMMARY OF THE INVENTION

In the preferred exemplary form of the invention as described in detail herein, it is a simplified construction having the parts as identified in the abstract. A pair of complementary jaw members can move or slide longitudinally within the body. The end part of the body is configurated to provide cam surfaces, and the complementary jaw members are shaped to engage the cam surfaces so that when the jaw members move inwardly in response to applied force against a nut, the jaw members are cammed together into tight engagement with the nut. Preferably, the inner ends of the jaw members are pivoted together and spring means are provided to normally urge the jaw members outwardly.

The primary object of the invention is to provide an improved automatic self-adjusting wrench which is effective for its purpose but which utilizes a fewer number of parts and which is of simpler construction.

A further object is to provide a wrench of the type referred to wherein the gripping force of the jaws is provided simply by camming action between the body and the jaws.

A further object is to simplify the construction by way of an arrangement wherein the jaws are simply adjacent to each other within the body with a floating connection between the inner ends of the jaw members.

Further objects and additional advantages of the invention will become apparent from the following detailed description and annexed drawings.

BRIEF DESCRIPTION OF THE PREFERRED EMBODIMENT

Figure 1:
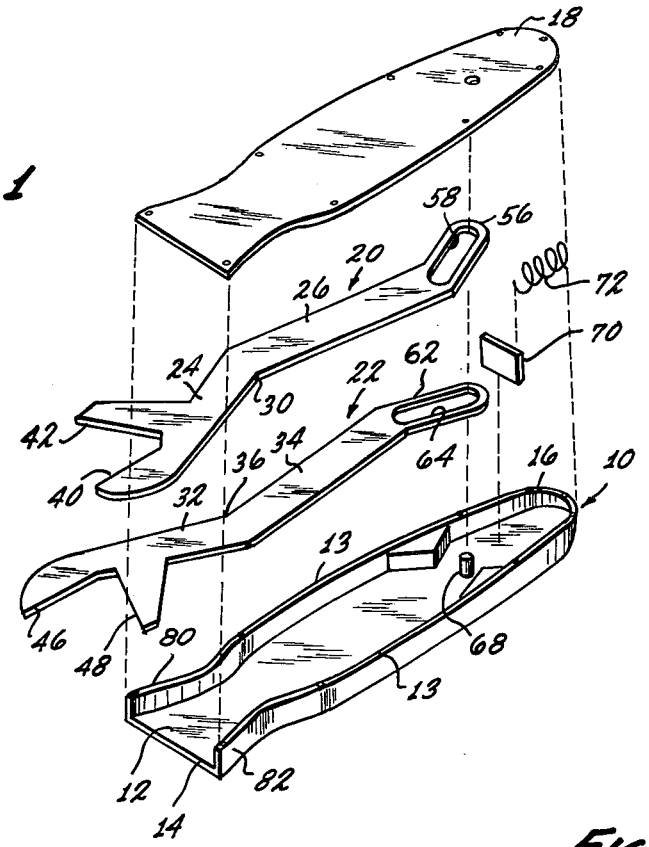
FIG. 1 is an exploded isometric view of a preferred form of the invention.

Referring to the drawings, the wrench comprises a body forming a container part as designated at 10 and having a configuration as shown in the drawings. The part 10 has a bottom 12, side walls as shown at 13 and an open front 14 and a rounded rear part 16. Numeral 18 designates a cover for the lower part 10 which may be secured in any suitable manner, such as by rivots, adhesively, or otherwise.

Within the body are provided two jaw members as designated generally at 20 and 22. The two jaw members have similar complementary shapes as may be seen in FIG. 2. Each jaw member is angular having outer and inner parts. Jaw 20 has an outer part 24 and an inner part 26 extending from angle 30. Jaw member 22 has an outer part 22 and inner part 34 extending from angle 36. The outer end of jaw member 24 is configurated to have extending parts as shown to provide nut engaging surfaces 40 and 42 which are at an angle to each other as shown adapting them to engage side surfaces of a hex nut 44. The outer end of jaw 22 is similarly configurated having extending portions providing flat surfaces 36 and 48 which are at an angle as shown adapting them to engage two other surfaces of the hex nut 44.

At the inner end of jaw 20 is an offset portion 56 having elongated slot 58. At the inner end of jaw 32 is complementary offset portion 62 having elongated slot 64. Numeral 68 designates a pin which engages in both the slots 58 and 64 providing a floating connection between the inner ends of the two jaw members. Numeral 70 and 72 designate coil compression springs attached to the jaws 20 and 22 which normally urges them outwardly within the body 10.

The outer end of the body 10 flares outwardly as designated at 80 and 82, the inner surfaces of these sidewall portions providing cam surfaces. The outer surfaces or backs of the outer parts 24 and 32 of the jaw members normally engage these cam surfaces which are at an angle which may be seen to the longitudinal axis of the body 10.

Figure 2:
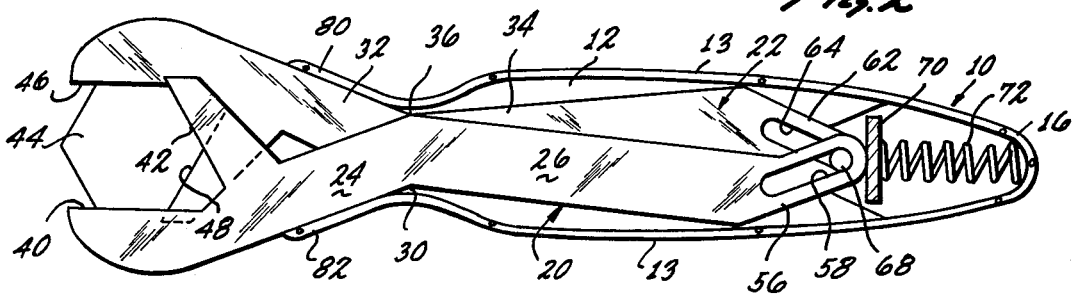
FIG. 2 is a plan view of the wrench with the cover removed and the jaw members in one position.

The operation of the wrench will be readily understood by those skilled in the art. FIG. 2 shows the wrench with the ends of the jaw members in engagement with flat surfaces of hex nut 44. As may be seen, the body of the wrench is grasped and force is applied urging the jaw members towards the nut; the reaction forces against the surfaces 42 and 48 of the jaw members will urge them inwardly into the body 10. The back surfaces of the jaw members in engagement with the cam surfaces on the inside of the wall members 80 and 82 will cam the jaw members toward each other with the jaw members moving inwardly into the body against the force of the springs 70 and 72. The pin 68 upstanding from the bottom of the part 10 will move in the slots 64 and 58. Thus, as may be seen as long as the body of the wrench is grasped and held, the springs will hold the jaw members in urging and holding relationship against the nut 44. As can readily be seen, the wrench will automatically adjust to any size nut in the same way.

Figure 3:
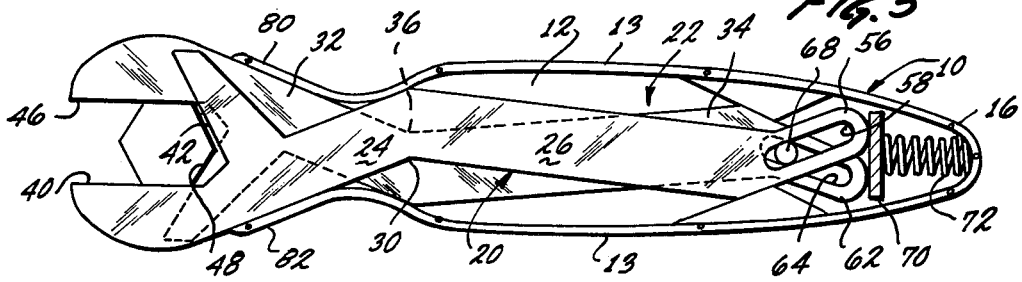
FIG. 3 is a view similar to that of FIG. 2 with the jaw members in another position.

FIG. 3 shows the wrench utilized to hold a hexagonal nut 35 of a smaller size. In this case, as may be seen, the jaw members 20 and 22 are in a position farther into the body 10, the jaw members having been urged together by the cam surfaces on the inside of the wall parts 80 and 82.

From the foregoing, those skilled in the art will readily understand the nature of the invention and the manner in which it achieves and realizes all of the objectives as set forth in the foregoing.

The foregoing disclosure is representative of a preferred form of the invention and is to be interpreted in an illustrative rather than a limiting sense, and the invention to be accorded the full scope of the claims appended hereto.

What is claimed is:

1. An automatic self-adjusting wrench comprising a body member, a pair of jaw members having portions fitting within the body member for longitudinal movement within the body member, the jaw members having confronting jaw faces movable toward and away from each other in response to inward longitudinal movement of the jaw members within the body, the body having camming surfaces positioned to engage the jaw members, the said jaw members having portions in juxtaposed relationship to said camming surfaces whereby inward movement of said jaw members with respect to the body causes the jaw members to be cammed toward each other for gripping, and resilient means normally resisting inward movement of the jaw members in the said body the said jaw members including flat faces adapted to engage against flat surfaces of a fastener element, said flat faces each lying at an acute angle to their respective jaw faces such that force exerted against the fastener element causes the jaw members to move towards each other.

2. A combination as in claim 1, wherein each of said jaw members has end faces configurated whereby to engage a nut having flat side surfaces.

3. A combination as in claim 1, including means whereby the two jaw members are linked together within the body member.

4. A combination as in claim 1, wherein the camming surfaces of the body are positioned at an angle to the axis of the body, said portions of the jaw members being configurated to lie against said camming surfaces, whereby to cause the jaw members to move towards each other when they are moved inwardly with respect to the body the engagement of said flat faces with the fastener element directly causing inward movement of the jaw members.

5. A combination as in claim 4, including the resilient means positioned to normally urge the jaw members outwardly with respect to the body.

6. A combination as in claim 1, wherein said jaw faces include flat faces that are parallel to each other and are adapted to engage against flat surfaces of a fastener.

7. A combination as in claim 1, wherein said flat faces are at an angle such that the force exerted against the fastener element directly causes the jaw members to move inwardly in the said body.

* * * * *